US008354619B2

(12) United States Patent
Perez

(10) Patent No.: US 8,354,619 B2
(45) Date of Patent: Jan. 15, 2013

(54) METHOD OF FABRICATING AN ELECTRIC WIRE HAVING A PTFE-BASED SHEATH, SAID ELECTRIC WIRE, AND A CORRESPONDING LUBRICANT EVAPORATION AND SINTERING LINE

(75) Inventor: Sophie Perez, Marchais En Brie (FR)

(73) Assignee: Axon'Cable, Montmirail (FR)

( * ) Notice: Subject to any disclaimer, the term of this patent is extended or adjusted under 35 U.S.C. 154(b) by 374 days.

(21) Appl. No.: 12/834,668

(22) Filed: Jul. 12, 2010

(65) Prior Publication Data

US 2012/0006579 A1 Jan. 12, 2012

(51) Int. Cl.
*F27B 9/06* (2006.01)

(52) U.S. Cl. ..... 219/388; 264/127

(58) Field of Classification Search ..... 219/388; 264/127; 425/380, 381, 467, 468
See application file for complete search history.

(56) References Cited

U.S. PATENT DOCUMENTS 3,869,235 A * 3/1975 Moore ..... 425/113
4,299,788 A * 11/1981 Ross ..... 264/85
5,874,032 A * 2/1999 Zdrahala et al. ..... 264/127
6,780,360 B2 * 8/2004 Lange et al. ..... 264/127

* cited by examiner

*Primary Examiner* — Jenny L. Wagner
*Assistant Examiner* — Mark Tornow
(74) *Attorney, Agent, or Firm* — Kenyon & Kenyon LLP

(57) ABSTRACT

An electric wire comprises a non-oxidized conductor of copper alloy having no outer coating and in direct contact with a PTFE-based sheath. It is fabricated as follows: providing a copper alloy conductor without an outer coating; forming a sheath of a PTFE-based material around the conductor; and heating the wire in order to evaporate the lubricant and sinter the sheath. In order to avoid oxidizing the copper during the heating step, the wire is heated mainly in an atmosphere having a low oxygen content. The lubricant evaporation and/or sintering line for stabilizing the sheath of the electric wire comprises one or more ovens, each having an enclosure in which an atmosphere having a low oxygen content is maintained.

15 Claims, 2 Drawing Sheets

METHOD OF FABRICATING AN ELECTRIC WIRE HAVING A PTFE-BASED SHEATH, SAID ELECTRIC WIRE, AND A CORRESPONDING LUBRICANT EVAPORATION AND SINTERING LINE

FIELD OF THE INVENTION

The present invention relates to an electric wire comprising at least one copper alloy conductor that is sheathed in a sheath based on polytetrafluoroethylene (PTFE), to a cable using at least one such wire, to a line for evaporating the lubricant and/or sintering said wire while it is being fabricated, and to a method of fabricating such a wire.

The term "PTFE-based sheath" is used herein to designate a sheath made of a material that is based on PTFE, i.e. that constitutes more than 50% by weight of PTFE.

The term "copper alloy" is used to designate any alloy having a majority of copper, and in particular it includes pure copper.

BACKGROUND OF THE INVENTION

It is known to fabricate an electric wire comprising a copper alloy conductor that is protected by a PTFE-based sheath. The wire is fabricated by forming a PTFE-based sheath around the copper alloy conductor.

If a "bare" conductor is used in such fabrication, i.e. a conductor that is not covered in an outer coating to protect it against oxidation, then during steps of lubricant evaporation and of sintering the PTFE sheath, a thin layer of copper oxide forms around the copper alloy conductor. Such an oxide layer is easily visible since it generally has a color that is quite different from that of copper. As a result of this oxide layer, the appearance of the copper is dark red or even black.

With such a conductor, the potential for soldering or for electric or ultrasonic welding is reduced, and contact resistance is high after crimping to connector elements.

That is why, in practice, no electric wire is fabricated in that way using a "bare" conductor. On the contrary, in order to avoid such problems, and in known manner, instead of using a bare copper alloy conductor, a copper alloy conductor is used that is also covered in an outer coating to protect it against oxidation. Such a coating is commonly a layer of silver or of nickel that is interposed between the atmosphere outside the wire and the conductor, so as to prevent any oxidation of the conductor. Naturally, applying such a coating leads to considerable extra cost for the conductor, and to increased complication in its method of fabrication.

A section of an electric wire having those characteristics is shown in FIG. 1. The electric wire 1 thus comprises a central conductor 11 of circular section, covered by an outer coating (anti-corrosion surface coating) 12, e.g. a layer of silver. The assembly is protected by an outer sheath 13 of substantially constant thickness that is based on PTFE.

With a wire having that structure, and by virtue of the anti-corrosion coating 12, no copper oxidation occurs at the surface of the conductor 11 during the steps of evaporating the lubricant and sintering the PTFE, which steps are performed after the PTFE sheath has been formed. However, having recourse to an anti-corrosion coating 12 leads to a method that is less simple and more expensive.

OBJECTS AND SUMMARY OF THE INVENTION

A first object of the present invention is to define a method of fabricating an electric wire comprising at least one conductor and a sheath based on PTFE, the method comprising the following steps:

providing at least one copper alloy conductor;

forming a sheath of a material based on PTFE filled with a lubricant around said at least one conductor; and heating the wire so as to cause the lubricant to evaporate and the PTFE-based sheath to sinter;

which method does not present the above-mentioned drawbacks associated with obtaining an electric wire in a PTFE-based sheath.

This object is achieved by the fact that the conductor is provided without an outer coating and the wire is heated mainly in an atmosphere having a low oxygen content.

The low oxygen content of the atmosphere surrounding the electric wire during the major portion of the heating stage prevents the conductor oxidizing while it is being heated. A small amount of exposure to an oxidizing atmosphere nevertheless usually remains acceptable; thus, when the electric wire is heated by being passed through a succession of ovens, the wire may be subjected to short stages of exposure to air in order to pass from one oven to the next without giving rise to visible oxidation on the conductor. Thus, it may be considered that the wire is heated mainly in an atmosphere having a low oxygen content providing that, during heating, the wire spends at least 80% of its time in an atmosphere having a low oxygen content, and preferably spends at least 95% of its time in such an atmosphere.

An atmosphere having a low oxygen content is an atmosphere in which the oxygen content is small, presenting an oxygen content of less than 5% (molar). Preferably, the oxygen content is reduced to less than 1%.

The oxidation of the conductor during the heating stage is associated with the high temperature and possibly also with the presence of hydrofluoric acid. Prior to sintering, the PTFE-based sheath is slightly porous and its specific gravity is of the order of 1.6. While PTFE is being sintered, the material of the sheath becomes more compact, with the pores formed in the sheath disappearing, and with the specific gravity of the PTFE increasing up to about 2.15.

Because of this transformation of the PTFE, the PTFE-based sheath advantageously becomes oxygen proof; as a result, once the sintering operation has advanced sufficiently, the conductor is protected from ambient oxygen by its PTFE-based sheath.

Also in accordance with the invention, it is possible to fabricate an electric wire having one or more conductors in a PTFE sheath, while using a conductor that is not covered by an outer coating, providing the above-mentioned precautions are taken so as to avoid exposing the electric wire to oxygen while it is being heated, and thus avoid oxidizing it. The invention makes it possible in particular to fabricate a single-strand electric wire in which a single copper conductor is sheathed in a PTFE-based sheath. The conductor is then merely a copper alloy wire and it is not constituted by twisting together a plurality of wires.

In an implementation, the wire is heated mainly in an atmosphere having a low oxygen content, once the temperature exceeds 100° C. This temperature is the recommended minimum temperature from which it is appropriate for the atmosphere surrounding the heated electric wire to be an atmosphere having a low oxygen content. Above this temperature, the oxidizing action of oxygen, possibly enhanced by the presence of hydrofluoric acid (HF) given off by the PTFE, leads progressively to the conductor being oxidized. Naturally, the lower the temperature from which the conductor is protected against oxidation by the atmosphere having a low oxygen content, and the greater the extent to which such protection is continuous, the less the oxidation of the conductor.

In an implementation, the wire is heated mainly in an atmosphere having a low oxygen content, at least until the PTFE-based sheath has sintered partially. Beyond a certain degree of sintering, the PTFE-based sheath becomes sufficiently oxygen proof to protect the conductor from oxidation.

In an implementation, the wire is heated mainly in an atmosphere having a low oxygen content by passing the wire through an oven containing a gas that is inert relative to the copper and that is at a positive relative pressure. This gas that is insert relative to copper is inert in the sense that it does not lead to any oxidation of the copper; it may be nitrogen or some other gas. In order to obtain an atmosphere having a low oxygen content, this gas is injected into the enclosure of the oven, and a small positive relative pressure is maintained inside the enclosure to ensure that ambient air does not penetrate into the oven.

Furthermore, in order to limit consumption of the gas that is inert relative to copper, the oven should be made as leak-tight as possible.

In an implementation, the wire is heated in an atmosphere having a low oxygen content so long as the specific gravity of the material of the sheath remains less than 2.1. At that specific gravity and above, the PTFE-based sheath may be considered as being sufficiently oxygen proof to avoid oxidation of the conductor(s) of the electric wire.

Furthermore, the invention may advantageously be implemented regardless of the method that is used for covering the conductor(s) in PTFE in order to form the sheath. Thus, the invention may be implemented in particular using pure PTFE to constitute the sheath, i.e. PTFE having no copolymer added thereto (e.g. selected from the family of fluoroethylenes).

In an implementation, the sheath is formed around the conductor by a method selected from extruding the sheath around the conductor(s), taping a tape around the conductor, coating by passing the conductor(s) through a bath containing a PTFE-based dispersion, and laminating the tape on the conductor(s).

In general, any method of forming a PTFE-based sheath around conductors can be used in the invention, and the preceding sentence lists only some of those methods. Whatever the method used to form the sheath around the conductor (s), PTFE needs to be heated in order to be sintered. The invention is thus characterized above all by the conditions under which the step of heating the electric wire is implemented after the sheath has been formed.

A second object of the invention is to remedy the above-mentioned drawbacks by defining an electric wire comprising at least one copper alloy conductor in a PTFE-based sheath, but not presenting the above-mentioned drawbacks of electric wires, in particular not presenting the complexity of their fabrication and the high cost of the necessary conductors.

This object is achieved by the fact that the conductor has no outer coating, with the sheath being in direct contact with the non-oxidized conductor, and the electric wire is fabricated using the above-described method.

The conductor(s) does not have any outer coating or surface coating. The copper alloy from which it is formed appears directly at its surface. Consequently, when the conductor is incorporated in the electric wire, the copper alloy is in contact with the PTFE-based sheath. Advantageously, the electric wire of the invention thus comprises a "bare" copper conductor incorporated in the PTFE sheath without being oxidized. No substance is interposed between the PTFE-based sheath and the copper alloy conductor, be that substance a copper oxide resulting from oxidation of the surface of the conductor, or a coating for protecting the conductor and that has been deposited thereon prior to forming the sheath. Because of the direct contact between the sheath and the conductor, good adhesion is obtained of the PTFE on the conductor.

By extension, a third object is to define an electric cable or cord that incorporates at least one electric wire having a copper alloy conductor in a PTFE-based sheath, but without the above-mentioned drawbacks of electric wires, in particular the complexity of their fabrication and the high cost of the necessary conductors.

This object is achieved by the fact that the electric cable or cord incorporates at least one conductor as defined above. Such an electric cable may be a coaxial cable, a multistrand cable, a cable incorporating fluid-transport channels, an optical fiber, etc. The term "electric cord" is used herein to designate a length of electric cable having connectors fastened to its ends.

A fourth object of the invention is to define a lubricant evaporation and sintering line for an electric cable comprising at least one copper alloy conductor in a PTFE-based sheath, said line incorporating at least one lubricant evaporation and/or sintering oven having an enclosure that is adapted to allow the wire to travel therethrough, together with heater means enabling the inside of the enclosure to be heated; the line serving to cause the lubricant in the PTFE to evaporate and to cause the PTFE of an electric wire sheath to sinter, while avoiding oxidation of the conductor during this operation, thereby enabling an electric wire to be fabricated in which the conductor (inside the sheath) does not have an outer coating, and remains non-oxidized inside the sheath after sintering.

This object is achieved by the fact that said at least one oven further includes means for maintaining an atmosphere having a low oxygen content inside the enclosure. Because of this low oxygen content, while the wire is passing through the oven(s), oxidation of the conductor does not occur or remains negligible. As a result, the line enables an electric wire to be obtained in which the conductor is not oxidized inside the PTFE-based sheath.

Naturally, the heater means must enable the temperature inside the enclosure to be raised to a temperature suitable for evaporating the lubricant from the PTFE that is used, or for sintering the PTFE.

The electric wire passes through the oven(s) preferably in an atmosphere having a low oxygen content as soon as the temperature exceeds 100° C. and at least until the PTFE-based sheath has sintered partially.

In an embodiment, the means for maintaining an atmosphere having a low oxygen content inside the enclosure comprise means for injecting a gas that is inert relative to copper into the enclosure. By injecting a gas that is inert relative to copper into its enclosure, the oven enables the electric wire to be heated while exposing the electric wire only to an atmosphere that has a low oxygen content; as a result, during the heating stage, the conductor is oxidized not at all or to a degree that is negligible.

Injecting the gas that is inert relative to copper, e.g. nitrogen or an equivalent, enables air to be replaced by said gas and thus enables the oven to contain an atmosphere having a low oxygen content.

In an embodiment, the means for injecting a gas that is inert relative to copper comprise a gas supply and a line for conveying gas from the supply to the enclosure, the gas coming from the supply being heated prior to being injected into the enclosure. This embodiment applies particularly in circumstances in which the gas is stored in a supply in the liquid phase or in a gaseous phase under high pressure. Either way, the gas either vaporizes or expands in order to reach injection pressure, so the temperature of the gas decreases considerably. It is therefore desirable for the gas to be heated prior to being injected into the enclosure of the oven so as to avoid creating an undesirable temperature gradient. This heating may advantageously be achieved by causing the gas to pass in the vicinity of the enclosure, close to the heater means. As a result the gas is heated and can then be injected into the enclosure at a temperature that is high enough, e.g. higher than 50° C.

In an embodiment, the enclosure is substantially leaktight with the exception of orifices provided for entry and exit of the wire, for injecting a gas that is inert relative to copper into the enclosure, and optionally for extracting gas from the enclosure. These provisions serve to limit the consumption of gas that is inert relative to copper and enhance obtaining a non-oxidizing atmosphere inside the enclosure.

In an embodiment, the oven also includes means for ejecting the gas contained in the enclosure. This ejection may be performed either by sucking the gas out from the enclosure so as to deliver it to the outside, or in certain circumstances merely by allowing the gas to flow out from the enclosure (given that it is at a positive pressure) via a passage having a check valve.

In general, the enclosure is designed to be disposed vertically. Ejection is preferably performed in the vicinity of the top points of the enclosure. Since the injected gas is usually colder than the atmosphere inside the enclosure, gas other than the injection gas generally concentrates at the end opposite to the injection point, and in particular towards the top of the enclosure, since its density is lower because it has been heated inside the enclosure.

By renewing the gas contained in the enclosure, the ejector means eliminate any gas other than the injected gas and in particular any oxygen that might be present in the enclosure, thereby contributing to reducing the oxygen content present inside the enclosure.

When a plurality of ovens are disposed one after another for evaporating the lubricant of the PTFE and for sintering the sheath, and in particular when the ovens are in vertical alignment one after another so as to form an oven column, the ejector means may be common to the various ovens.

In an embodiment, the evaporation and/or sintering line comprises a plurality of ovens having their enclosures connected to one another via at least one connector, the connection being isolated from the outside in leaktight manner by the connector. This configuration makes it easier to maintain an atmosphere having a low oxygen content, and in particular it enables a plurality of ovens that are connected together by such connectors to share common means such as means for injecting a gas that is inert relative to copper and/or means for ejecting gas.

In an embodiment of such an evaporation and/or sintering line, a plurality of ovens are arranged in line on a common vertical axis to form an oven column, and said oven column is fastened axially at a single level along its vertical axis so as to leave it free to expand thermally in the vertical direction.

Since the sintering temperature of PTFE is about 350° C., the oven is subjected to temperature differences that are large and thus to thermal expansions that are large between its cold state and its in-use state. Usually, the expansions and contractions due to temperature effects are accommodated by expansion joints. By fastening the oven column axially at a single level only (i.e. substantially in a single plane perpendicular to the longitudinal axis of the enclosure), it is possible to avoid having recourse to expansion joints, thereby increasing the leaktightness of the column, reducing inert gas consumption, and reducing the cost of fabricating the electric wire.

BRIEF DESCRIPTION OF THE DRAWINGS

The invention can be well understood and its advantages appear better on reading the following detailed description of embodiments given as non-limiting examples. The description refers to the accompanying drawings, in which.

MORE DETAILED DESCRIPTION

Figure 1:
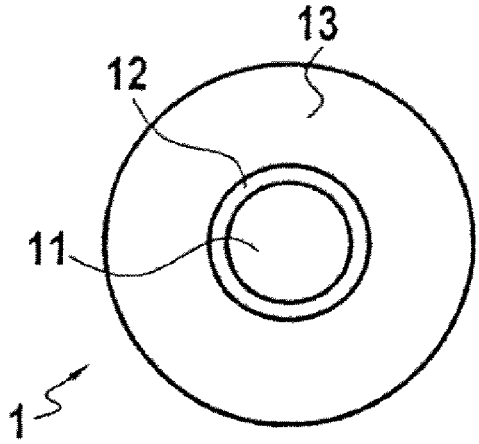
FIG.1 PRIOR ART
FIG. 1 is a section of an electric wire comprising a conductor in a sheath based on PTFE in a prior art embodiment, as described above.
Figure 2:
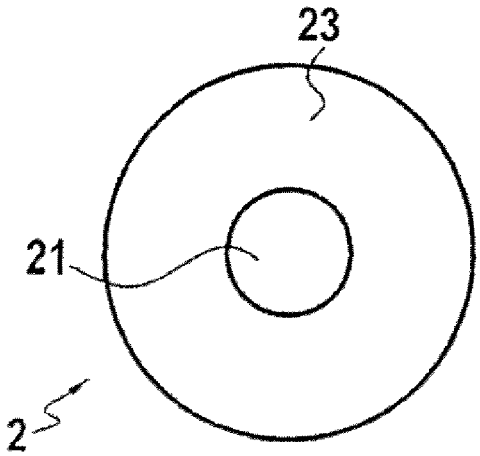
FIG. 2 is a section of an electric wire comprising a conductor and a sheath based on PTFE, in accordance with the invention.

With reference to FIG. 2, an electric wire of the invention is described below.

The electric wire 2 comprises a central conductor 21 of circular section made of copper alloy, placed inside an outer sheath 23 based on PTFE, the sheath being of substantially constant thickness. The material of the outer sheath 23 is in direct contact with the central conductor 21. The central conductor 21 does not have any coating, in particular it does not have any anti-corrosion coating. It is not oxidized. Naturally, in other embodiments, an electric wire of the invention may include a plurality of conductors, the number of conductors that can be incorporated in the PTFE-based sheath depending on the method selected for forming the sheath. It should also be observed that an electric wire such as the wire 2 shown in FIG. 2 may itself be a component of an electric cable of more complex structure, e.g. a coaxial cable having its core constituted by the conductor 21. A portion of such an electric cable may be provided with connectors so as to constitute an electric cord.

Furthermore, the electric wire 2 may be shaped so as to be substantially rectilinear, or it may be a twisted electric wire, etc. The PTFE-based sheath may include other structural elements, e.g. channels for passing air, optical fibers, metal or other reinforcement, and/or other elements.

Figure 3:
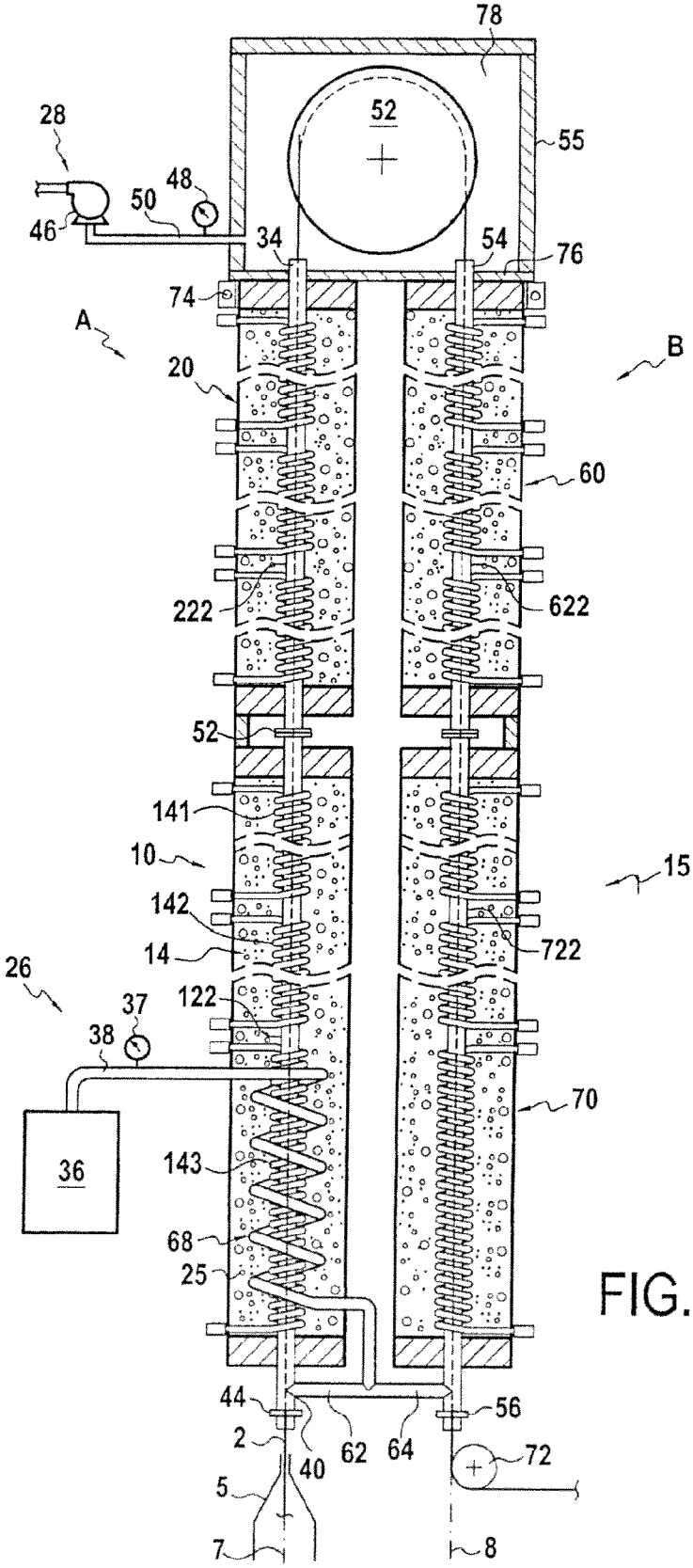
FIG. 3 is an axial section of a lubricant evaporation and sintering line for an electric wire of the invention.

With reference to FIG. 3, there follows a description of a method in accordance with the invention for fabricating an electric wire comprising at least one conductor in a PTFE-based sheath. In this example, the wire has a single conductor. Nevertheless, it will readily be understood that the method may equally well be implemented to fabricate an electric wire having a plurality of conductors.

In the method, fabrication of the wire begins with a step that is not shown of forming the PTFE-based sheath around the electrical conductor. This step is generally a step of extruding PTFE around the copper alloy conductor. Since such a forming step is itself known, it is not shown or described in detail in this application. More generally, any other method of forming the PTFE-based sheath could be used to form the sheath, while remaining within the ambit of the invention.

After the sheath has been formed, there follows a step of heating the electric wire so as to evaporate the lubricant contained in the PTFE, where necessary, and so as to sinter the PTFE in order to give it its permanent properties.

FIG. 3 shows a line 15 for evaporating the lubricant and for sintering the PTFE and that enables this heating step to be performed.

The line 15 is located in the immediate vicinity of the wire outlet orifice from tooling 5 for forming the PTFE-based sheath (an extruder).

The line has four ovens 10, 20, 60, 70 disposed one after another along a path for an electric wire 2 delivered at the outlet of the tooling 5 for forming the sheath of the wire. The ovens 10, 20, 60, 70 are substantially identical to one another, except in particular for the settings of the temperatures that exist inside each of them, and except for the nitrogen heating equipment, as described below.

The ovens in the line 15 are grouped as two oven columns A and B. The first oven column A is constituted by two first ovens 10 and 20 in vertical alignment, these ovens being lubricant evaporation ovens and being disposed successively one after the other along a common vertical axis 7, above the outlet orifice from the extruder 5.

The second oven column B is made up of two ovens 60 and 70 in vertical alignment, these ovens being sintering ovens; their temperature is adjusted to enable PTFE to be sintered, i.e. about 350° C. (the lubricant-evaporation ovens being at a lower temperature, about 250° C.). The ovens 60 and 70 are disposed along a vertical axis 8 parallel to the axis 7 and immediately beside it.

In the line 15, the electric wire 2 coming from the extruder 5 thus passes vertically upwards through the lubricant-evaporation ovens 10 and then 20. It leaves these ovens via an orifice 34 at the top of the oven 20 and is guided by a pulley 52 so as to be directed onto the axis of the ovens 60 and 70, penetrating into the oven 60 via an inlet orifice 54, and then passing vertically downward through the ovens 60 and then 70.

On passing through the ovens 10, 20, 60, and 70, the sheath of the electric wire is subjected to high temperatures that lead to the lubricant being evaporated, essentially in the ovens 10 and 20, and then to the PTFE sheath being sintered in the ovens 60 and 70. At the outlet from the oven 70, the sheath is in its final state, and it is proof against oxygen, thus serving to protect the surface of the conductor against oxidation by oxygen in the air.

On leaving the oven column B via the orifice 56 of the oven 70, the electric wire is entrained by a pulley 72 and is directed towards winder means that are not shown. The wire is also entrained by entrainment means that are not shown.

The oven columns A and B are suspended from a support wall (not shown) by fastener tabs 74. These fastener tabs 74 are located at a single level relative to the vertical axes 7 and 8 of the columns, at the top of the columns A and B so as to leave the two oven columns A and B free to expand thermally in the vertical direction.

The structure of the line 15 is described in greater detail below, by describing the structure of the lubricant-evaporation oven 10 in detail. Since the other ovens 20, 60, and 70 are substantially identical, they are not described in detail.

The oven 10 comprises a tubular enclosure 122 and heater means 14 for heating the wire 2. It uses injector means 26 for injecting inert gas into the ovens, and ejector means 28 for ejecting the gas contained in the enclosures of the ovens. These various means 26 and 28 are arranged in common at least in part in the line 15 so as to serve all of the ovens.

In general, in the invention, the heater means 14, the injector means 26, and the ejector means 28 for ejecting the gas contained in the enclosure may either be specific to one oven, or else common to an oven column (a set of ovens in alignment on a common vertical axis), or else common to a set of ovens such as the set of ovens constituting a lubricant evaporation and sintering line. In the line 15, the injector means 26 and the gas ejector means 28 are common to the entire line 15.

In order to heat the wire 2, the oven 10 has a tubular enclosure 122 formed by a leaktight tube of stainless steel or aluminum, having a diameter lying in the range 30 millimeters (mm) to 40 mm. The wire 2 penetrates into the enclosure 122 via the orifice 44 situated at the bottom thereof, and then passes upwards through the enclosure 122 on the axis 7 of the enclosure 122.

The oven 20 also includes an enclosure 222 similar to the enclosure 122 of the oven 10. The enclosure 222 is in alignment with the enclosure 122 and is placed thereafter. On leaving the enclosure 122, the wire 2 penetrates into the enclosure 222 without passing through ambient air, and then after passing through the enclosure 222 it leaves it via an exit orifice 34 disposed at the top of the enclosure 222.

The heater means 14 of the oven 10 are constituted by three electric resistor elements 141, 142, and 143. These resistor elements are helical in shape and they wind around the tubular enclosure 122, being regularly distributed along its entire length so as to heat it in regular manner and raise it to a temperature that is suitable for evaporating the lubricant contained in the sheath. Since the tubular enclosure 122 is made of metal, it transmits the heat it receives and communicates it inside to the wire 2. The resistance elements 141, 142, and 143 are connected to electrical power supply means that are not shown.

In order to limit unwanted heat losses, the oven 10—and also the other ovens—has rock wool lagging 25 in the form of a sleeve surrounding the tubular embodiment 122.

The means implemented for controlling the composition of the atmosphere surrounding the electric wire during fabrication are described below. These means comprise in particular the inert gas injector means 26 and the ejector means 28 of the line 15.

It should initially be observed that the inlet and outlet orifices 44 and 56 for the wire located respectively at the bottoms of the columns A and B by which the wire enters or leaves the oven columns, are fitted with respective diaphragm type sealing devices, thereby minimizing the amount of gas that passes through these orifices and thus limiting penetration of gas into the enclosures 122-222 and 622-722 (where the enclosures 622 and 722 are the enclosures of the ovens 60 and 70 respectively).

Furthermore, nitrogen is injected as an inert gas into the oven columns using the injector means 26 that are common for the entire line 15. These means 26 comprise a supply of inert gas 36 constituted by a bottle of nitrogen, and a line 38 for conveying the gas from the supply 36 to the ovens. The line 38 has branches for injecting nitrogen both into the bottom of the enclosure 122 of the oven 10 so as to inject nitrogen into the first oven column A via an injection line 62, and into the bottom of the enclosure 722 of the oven 70 in the second oven column B, via an injection line 64. Furthermore, an optional flow rate regulator device 37 is installed on the line 38 for regulating the flow of inert gas.

For the oven 10, the nitrogen injection point 40 is close to the point 44 where the wire penetrates into the oven 10.

Furthermore, upstream from the injection point 40, the nitrogen pipe line 38 passes through the bottom portion of the oven 10 inside the lagging 25 in the form of a helical portion 68 presenting a certain number of turns wound around the tubular enclosure 122 but without making contact therewith. This helical portion 68 for heating the nitrogen serves to raise the temperature of the nitrogen and thus avoids injecting nitrogen into the enclosures of the ovens at a very low temperature, which would lead to considerable temperature gradients that would apply mechanical stresses within the oven and harm the properties of the electric wire being fabricated.

Within a given oven column (A or B), the enclosures of two consecutive ovens are in communication with each other. Thus, in the first oven column A, the enclosures 122 and 222 are in communication, being connected together by a connector 52. The connector isolates the common inside volume of the enclosures 122 and 222 from the outside.

In this way, in each of the oven columns A and B respectively, the enclosures 122-222 and 622-722, respectively, connected together in pairs, form respective common inside volumes within each column that are substantially isolated from the outside. That is why, for each oven column, it suffices to have one inert gas injection point at the bottom of the column and one point for sucking gas out from the enclosure at the top of the column. Furthermore, because of the relatively good sealing that is obtained in this way for the enclosures 122-222 and 622-722, the nitrogen delivered by the injector means 26 constitutes practically all of the gas surrounding the electric wire 2 as it travels through these enclosures.

The gas is sucked out or ejected at the tops of the oven columns A and B. At the tops of the two oven columns A and B, the ends of the enclosures 222 and 622 open out through a leakproof plate 76 into an enclosure 78 that is isolated from the outside by a casing 55. The casing 55 contains the pulley 52 such that the electric wire 2 that is being fabricated passes from the oven 20 to the oven 60 via the pulley 52 without leaving the enclosure 78 and thus without passing through an atmosphere having a high oxygen content. The inside of the casing 78 contains the gas coming from the enclosures 122-222 and 622-722 of the ovens, and thus like them it has a low oxygen content.

This low oxygen content is ensured by the forced renewal of the gas contained in the enclosures 122-222, 622-722, and 78, by the gas ejector means 28.

The ejector means 28 are gas suction means arranged to suck out the gas contained in the enclosure 78. Since the enclosure 78 communicates via the wire-passing orifices 34 and 54 with the enclosures 122-222 and 622-722, the sucking out and renewal of the gas contained in the enclosure 78 leads to the gas contained in the enclosures 122-222 and 622-722 being sucked out and renewed.

The ejector means 28 comprise a suction pipe 50 that communicates with the inside of the casing 55, a pump 46 that sucks in the gas conveyed by the pipe 50 and delivers it to the outside of the ovens, and a pressure gauge 48.

The pressure gauge 48 serves to measure the pressure in the suction pipe 50 and to verify at all times during fabrication that the enclosures of the ovens in the columns A and B remain at a positive relative pressure, thereby ensuring that the atmosphere within the enclosures has a low oxygen content, not only in the enclosure 78 around the wire as it passes from oven column A to oven column B, but also for the enclosures 122-222 and 622-722 of the ovens.

What is claimed is:

1. A method of fabricating an electric wire comprising at least one conductor and a sheath based on PTFE, the method comprising:

providing at least one copper alloy conductor;

forming a sheath of a material based on PTFE filled with a lubricant around said at least one conductor; and heating the wire so as to cause the lubricant to evaporate and the PTFE-based sheath to sinter;

wherein the conductor is provided without an outer coating and the wire is heated mainly in an atmosphere having an atmosphere in which the oxygen content is less than 5%.

2. A fabrication method according to claim 1, wherein the wire is heated mainly in an atmosphere having a low oxygen content, once the temperature exceeds 100° C.

3. A fabrication method according to claim 1, wherein the wire is heated mainly in an atmosphere having a low oxygen content at least until the PTFE-based sheath has sintered partially.

4. A fabrication method according to claim 1, wherein the wire is heated mainly in an atmosphere having a low oxygen content by passing the wire through an oven containing a gas that is inert relative to the copper and that is at a positive relative pressure.

5. A fabrication method according to claim 1, wherein the wire is heated in an atmosphere having a low oxygen content so long as the specific gravity of the material of the sheath remains less than 2.1.

6. A fabrication method according to claim 1, wherein the sheath is formed around the conductor by a method selected from extruding the sheath around the conductor(s), taping a tape around the conductor, coating by passing the conductor (s) through a bath containing a PTFE-based dispersion, and laminating a tape on the conductor(s).

7. An electric wire comprising at least one copper alloy conductor in a PTFE-based sheath, the conductor having no outer coating and the sheath being in direct contact with the non-oxidized conductor; wherein the electric wire is fabricated by the method according to claim 1.

8. An electric cable or cord incorporating at least one electric wire according to claim 7.

9. A line for evaporating lubricant and/or for sintering for use with an electric wire comprising at least one copper alloy conductor in a PTFE-based sheath, said line comprising at least one lubricant evaporation and/or sintering oven having an enclosure adapted to allow the wire to travel therein, and a heating device enabling the inside of the enclosure to be heated; wherein said at least one oven further includes a device for maintaining an atmosphere inside the enclosure having an oxygen content of less than 5%.

10. A line according to claim 9, wherein the device for maintaining an atmosphere having a low oxygen content inside the enclosure comprises a device for injecting a gas that is inert relative to copper into the enclosure.

11. A line according to claim 10, wherein the device for injecting a gas that is inert relative to copper comprises a gas supply and a line for conveying gas from the supply to the enclosure, the gas coming from the supply being heated prior to being injected into the enclosure.

12. A line according to claim 9, wherein the enclosure is substantially leaktight with the exception of orifices provided for entry and exit of the wire, for injecting a gas that is inert relative to copper into the enclosure, and optionally, for extracting gas from the enclosure.

13. A line according to claim 9, further including an ejection device for ejecting the gas contained in the enclosure.

14. A line according to claim 9, comprising a plurality of ovens having their enclosures connected to one another via at least one connector, while being isolated from the outside in leaktight manner by said connector.

15. A line according to claim 9, comprising a plurality of ovens disposed in alignment along a common vertical axis in order to form an oven column, the oven column being secured axially at a single level along its vertical axis so as to leave it free to expand thermally in the vertical direction.

* * * * *